United States Patent [19]

Obermayer et al.

[11] 4,393,822

[45] Jul. 19, 1983

[54] WATER-COOLED, MULTI-CYLINDER INTERNAL COMBUSTION ENGINE

[75] Inventors: Bertram Obermayer; Othmar Skatsche; Josef Greier, all of Graz, Austria

[73] Assignee: Hans List, Graz, Austria

[21] Appl. No.: 178,586

[22] Filed: Aug. 15, 1980

[30] Foreign Application Priority Data

Aug. 28, 1979 [AT] Austria ..... 5759/79

[51] Int. Cl.[3] ..... F02F 7/00

[52] U.S. Cl. ..... 123/195 R; 123/41.74

[58] Field of Search ..... 123/41.74, 195 R, 195 C

[56] References Cited

U.S. PATENT DOCUMENTS

| | | | |
|---|---|---|---|
| 1,219,781 | 3/1917 | Salisbury | 123/195 R |
| 1,836,189 | 12/1931 | Salisbury | 123/195 R |
| 1,916,292 | 7/1933 | Woolson | 123/195 R |
| 2,734,497 | 2/1956 | Chayne | 123/41.74 |
| 4,280,453 | 7/1981 | List et al. | 123/195 R |
| 4,343,271 | 8/1982 | Skatsche et al. | 123/195 R |

*Primary Examiner*—Craig R. Feinberg

*Attorney, Agent, or Firm*—Watson, Cole, Grindle & Watson

[57] ABSTRACT

In a water-cooled, multi-cylinder internal combustion engine, which comprises cylinders and a cooling jacket, the cylinders are connected in the lower region thereof to each other and to the cooling jacket, and crankshaft main bearings consisting of two parts which are mutually connected by means of main bearing bolts, the lower ends of the cylinders are connected to the cooling jacket at a height from the bottom edge of the cylinders corresponding to 0.5 to 0.75 times the cylinder diameter, and downwards from this level the lower cylinder ends are connected to each other but otherwise free and unconstrained, and the threads for the main bearing bolts are arranged at a height from the bottom edges being at least that great as the distance of the connection between the cylinders to the bottom edges.

Thereby, reaction forces from the main bearing bolts are transmitted directly to the region above the connection between the cylinders and the cooling jacket or are transmitted through the junction between the cylinders and cooling jacket and distributed to the cylinders and the cooling jacket in that region thereof which is above the junction. The unconstrained lower end of each cylinder is free from reaction forces thus avoiding unacceptable deformation in this region. Also, it is possible to choose a comparatively small working clearance between piston and cylinder which means less noise generation. Moreover, piston rings with lower tensions may be used, which means lower friction and, owing to the drastically reduced liner deformation, also less oil consumption.

4 Claims, 4 Drawing Figures

WATER-COOLED, MULTI-CYLINDER INTERNAL COMBUSTION ENGINE

BACKGROUND OF THE INVENTION

This invention relates to a water-cooled, multi-cylinder internal combustion engine which comprises cylinders and a cooling jacket, the cylinders being connected in the lower region thereof to each other and to the cooling jacket, and crankshaft main bearings consisting of two parts which are mutually connected by means of main bearing bolts.

DESCRIPTION OF THE PRIOR ART

There are known combustion engines of the kind specified wherein the cylinders are connected to each other and to the cooling jacket at the lower end thereof and the junction between the two cylinders is also the point of emergence of the bearing wall which carries the respective crankshaft bearing. This type of construction is capable of providing adequate cooling for the whole cylinder owing to the fact that the cooling water space extends almost fully down to the lower end of the cylinder; however, owing to the very rigid lower end of the cylinder, and to the reaction forces which are transmitted to cylinder and cylinder liner through the bearing walls at the junction between adjacent cylinders, deformations tend to occur particularly in the region of the lower ends of cylinders. In order to control such deformations of the cylinders and cylinder liners in the lower region thereof it is necessary in this known construction to provide, from the outset, a wider working clearance between piston and cylinder liner and to compensate cylinder liner deformation by higher piston ring tension. Naturally this entails greater friction and frictional energy losses, increased noise generation and higher oil consumption.

Furthermore, there are heavy internal combustion engines known wherein, in view of the comparatively wide space between the cylinders, the main bearing walls, which in this case also carry the camshaft bearings, are extended upwardly to a connecting web between two adjacent cylinders which web seals off the cooling water space and is arranged at a height corresponding to approximately half the cylinder diameter. This means that the lower ends of the cylinders below the connecting web are virtually free and unconstrained and consequently no longer subject to reaction forces which are transmitted solely through the connecting web and there is less risk of deformation of the lower ends of the cylinders. This obvious drawback of this known construction, however, resides in that, in order to permit such an upward extension of the main bearing walls at all, there must be a relatively wide spacing between cylinders and this effectively precludes a compact engine design.

SUMMARY OF THE INVENTION

It is an object of the present invention to provide load and stress relief for the lower ends of the cylinders, and thus prevent their undesirable deformation, also in compact, modern internal combustion engines of the kind specified.

According to this invention this is achieved due to the fact that the lower ends of the cylinders are connected to the cooling jacket at a height, from the bottom edge, on the cylinder which corresponds to 0.5 to 0.75 times, preferably 0.6 to 0.7 times the cylinder diameter and from this level downwards they are connected to one another but otherwise free and unconstrained, the threads for the main bearing bolts being arranged in this region or thereabove. Owing to these provisions reaction forces from the main bearing bolts are transmitted directly to the region above the connection between the cylinders and the cooling jacket or are transmitted through the junction between the cylinders and cooling jacket and distributed to the cylinders and the cooling jacket in that region thereof which is above the junction. In any case this arrangement ensures that the unconstrained lower end of the cylinder is free from reaction forces thus avoiding unacceptable deformation in this region. Also, it is possible to choose a comparatively small working clearance between piston and cylinder which means less noise generation. Moreover, piston rings with lower tensions may be used, which means lower friction and, owing to the drastically reduced liner deformation, also less oil consumption.

According to a further development of this invention the lower ends of the cylinders may be completely free and unconstrained from the bottom edges up to a height on the cylinder corresponding to 0.2 to 0.4 times the cylinder diameter. This means that the lower ends of the cylinders may also be free and unconstrained in the region of the junction between two cylinders which achieves a further reduction in stress applied to the ends of the cylinders and cylinder liners in this region and consequent deformations despite the preservation of the facility provided by means of the connection between cylinders to transmit reaction forces from the main bearing bolts or their lugs to the region above the junction between the lower ends of the cylinders and the cooling jacket.

According to a further development of this invention as applied to an engine wherein the cylinder block is integral with the crankcase, the main bearing walls are provided with an opening in the region between the lower ends of the cylinders. This opening in the main bearing wall permits the transmission of reaction forces from the main bearings to the region of the junction between the ends of the cylinders and cooling jacket without interfering with the freedom of the lower ends of the cylinders in this area.

In further development of this invention, the cylinder block is secured to the crankcase by means of the main bearing bolts, and a gap is provided between the bottom edge of the cylinders and the crankcase thus preserving the freedom of the lower ends of the cylinders despite the connection of cylinder block and crankcase by means of the main bearing bolts.

DESCRIPTION OF THE DRAWINGS

The present invention is hereinafter more particularly described with reference to various embodiments thereof shown by way of example in the accompanying drawings wherein.

DESCRIPTION OF THE PREFERRED EMBODIMENTS

Figure 1:
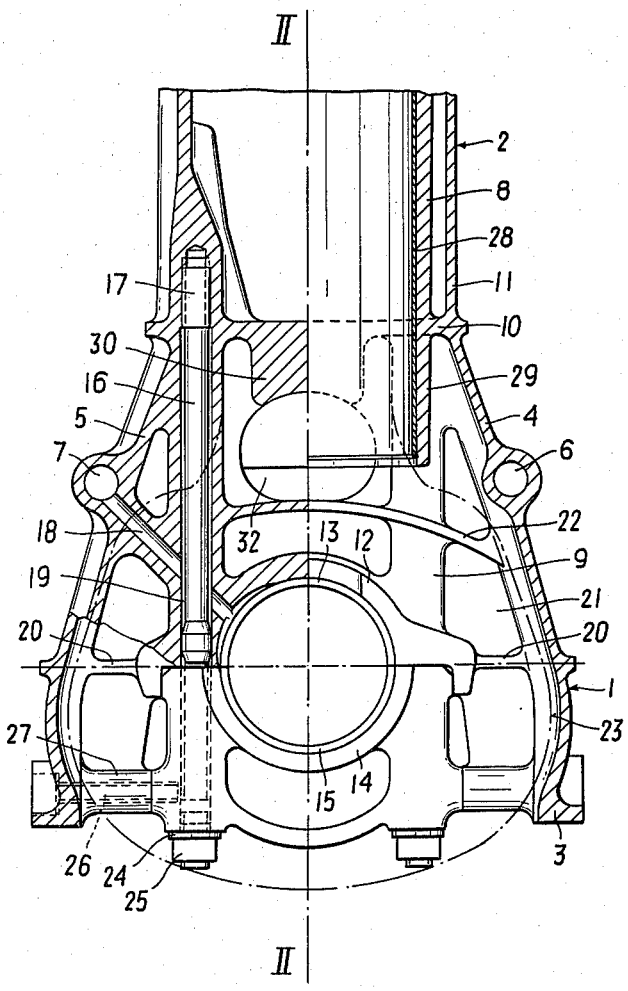
FIG. 1 is a partial vertical section through a multi-cylinder, internal combustion engine according to this invention, the section being taken in the plane between cylinders on the left hand side and in the medial cylinder plane on the right hand side of this figure.

In FIG. 1, a crankcase 1 of an internal combustion engine (not specifically shown) is cast in one piece with a cylinder block 2. On its underside the crankcase 1 comprises a securing flange 3 for the attachment and sealing of an oil sump (not shown). In the upper part of the crankcase 1 external walls 4 and 5 are provided with longitudinal bores 6 and 7, respectively, carrying cooling and lubricating oil.

Figure 2:
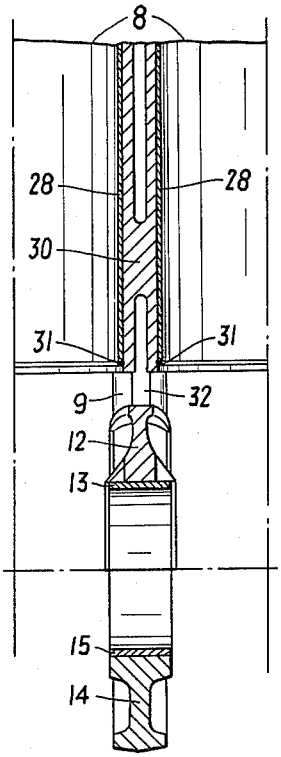
FIG. 2 is a partial section taken on the line II—II in FIG. 1.

In the plane between the cylinders 8, as will also be seen from FIG. 2, there is arranged in each case a main bearing wall 9 which merges at its upper end with a connection 10 between the cylinders 8 or between the cylinders 8 and a cooling jacket 11. At its lower end the main bearing wall 9 carries the upper part of a crankshaft bearing 12 together with an upper bearing shell 13. The lower part of the crankshaft bearing consists of a lower bearing part 14 and a lower bearing shell 15 which are mounted by means of main bearing bolts 16, which are received in corresponding lugs on the bearing part 14.

The main bearing wall 9 and the screw threads 17 for the bolts are arranged above the connection 10 between cylinders 8 and cooling jacket 11. In the region of intersection with the oil feed bore 18 the main bearing bolt bore forms an annular space 19 around the main bearing bolt 16 to allow unimpeded flow of oil to the bearing shells 13 and 15. The main bearing wall 9 is connected by means of webs 20, 21 and 22 to the outside walls 4 and 5 of the crankcase 1 which are shaped to blend with the connecting rod big end shroud 23. The bearing part 14 which is secured relative to the main bearing wall 9 by means of the main bearing bolts 16 through washers 24 and nuts 25, is secured relative to the crankcase 1 by means of bolts 26 extending through lugs 27.

The cylinders 8, which contain cylinder liners 28 are completely free and unconstrained at their lower ends 29 below the connection 10 to the cooling jacket 11, relative to crankcase 1 and main bearing wall 9. A ring 31 is provided as an additional safety precaution to prevent the cylinder liners 28 from falling out of the cylinders 8.

The unconstrained lower ends 29 of the cylinders are mutually connected in a region 30, the main bearing wall 9 being provided with an opening 32 in this region which ensures complete freedom of the lower ends of the cylinders up to a height which corresponds to 0.2 to 0.4 times the cylinder diameter.

When the engine is running the reaction forces generated in the crankshaft bearings by the combustion forces are transmitted partly through the main bearing wall 9 and the webs 20, 21, 22 to the crankcase 1 and partly through the bearing part 14 and the main bearing bolts directly to the cylinders 8 or the cooling jacket 11 in the region above the connection 10. Moreover, there is also a distribution of reaction forces towards the middle of the cylinder through the connecting region 30 between the cylinders 8 resulting overall in a relatively even distribution of these reaction forces to the engine unit as a whole and thus avoiding unfavorable stress distribution which could lead to undesirable deformations. The free lower ends 29 of the cylinders are completely relieved of reaction forces due to the proposed arrangement so that deformations in this region are very largely prevented.

Figure 3:
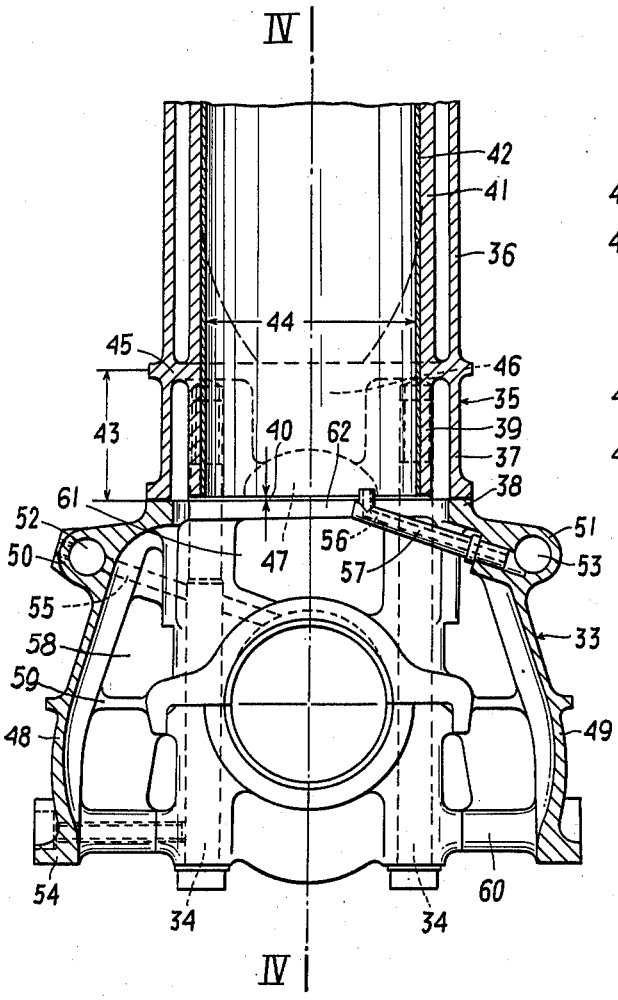
FIG. 3 is a partial vertical section taken through the medial cylinder plane of another embodiment of the invention.
Figure 4:
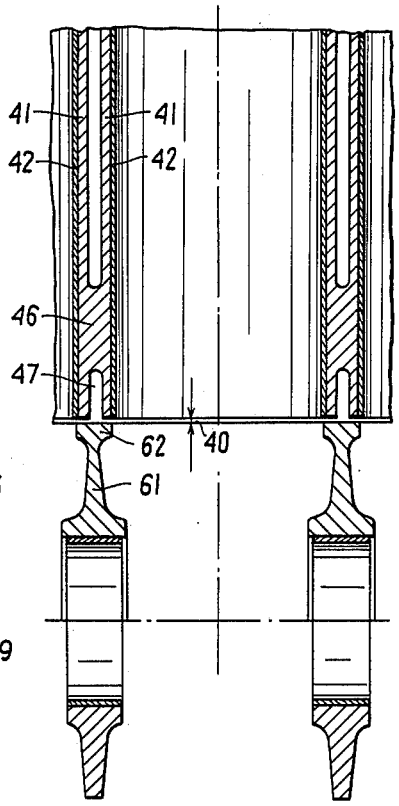
FIG. 4 is a partial section taken on line IV—IV in FIG. 3.

The embodiment shown in FIGS. 3 and 4 comprises a crankcase 33 on which a cylinder block 35 is mounted by means of main bearing bolts 34. The cylinder block 35 has a downwardly directed extension 37 in prolongation of a cooling jacket 36 whereby it is supported on and sealed relative to a flange 38 on the crankcase 33. The lower ends 39 of the cylinders are free and unconstrained relative to this extension 37 and there is a gap 40 between them and the crankcase 33 which is just large enough to ensure that the lower ends 39 of the cylinders are also completely free relative to the crankcase.

The cylinders 41 contain cylinder liners 42 which are, for example, adhesively secured therein, and, at a height 43 which corresponds to 0.5 to 0.75 times, preferably 0.6 to 0.7 times the cylinder diameter 44, they are connected to the cooling jacket 36. Below the junction 45 the cylinders 41 are mutually connected in a region 46. In this arrangement also an opening 47 ensures complete freedom from constraint for the lower ends 39 of the cylinders in the region of the connection between cylinders 41.

The exterior walls 48, 49 of the crankcase 33 are provided with lugs 50, 51 to accommodate lubricating oil and cooling oil ducts 52, 53 and a flange 54 is provided on the underside of the crankcase for the connection thereto of the oil sump (not shown). Lubricating oil is fed through a bore 55 whilst a bore 56 in a jet pipe 57 carries and feeds cooling oil to the pistons.

The upper part 62 of the bearing wall 61 is arranged in such a way that in this case also, a gap 40 is preserved relative to the lower ends 39 of the cylinders, whilst on the other hand an additional safety measure is provided against the risk of the adhesively secured liners 42 falling out of their cylinders.

As in the previous embodiment reaction forces are transmitted on the one hand through webs 58, 59, bearing wall 61 and lugs 60 to the crankcase 33, and on the other hand, through the main bearing bolts 34 into the region 46 of the connection between cylinders 41, thus achieving a favorable distribution of these forces and complete stress relief for the lower ends 39 of the cylinders.

In other words, in this arrangement undue deformation of the lower ends 39, of the cylinders by transmission of reaction forces to these ends is again completely prevented so that the working clearance which is required between the cylinder liners 42 and the pistons (not shown) may be smaller than in the earlier mentioned conventional construction. This enables a significant reduction in noise generation in this region. Furthermore, owing to improved concentricity of the cylinder liners 41 lower-tension piston rings may be used thus affording further reductions in friction and oil consumption.

I claim:

1. A water-cooled internal combustion engine comprising:

a cylinder block;

a cooling jacket provided in said cylinder block;

a plurality of in-line cylinders provided in said cylinder block each having a cylinder diameter, a lower end portion and a bottom edge portion;

a plurality of crankshaft main bearings each formed from first and second bearing portions;

a plurality of main bearing bolts each having threads formed thereon for mutually connecting said first and second bearing portions;

means for connecting each of said cylinders to said cooling jacket at said lower end portion of each of said cylinders at a distance from said bottom edge portions of each of said cylinders corresponding to 0.5 to 0.75 times said cylinder diameter; and means for exclusively interconnecting said lower end portion of each of said cylinders wherein said means for exclusively interconnecting said lower end portion of each of said cylinders is disposed between adjacent cylinders below said means for connecting said cylinders to said cooling jacket such that said lower end portion of each of said cylinders is substantially unconstrained from said bottom edge portion of each of said cylinders up to a distance corresponding to 0.2 to 0.4 times said cylinder diameter, and wherein said threads formed on said main bearing bolts are disposed within said cylinder block at a distance from said bottom edge portion of each of said cylinders at least as great as the distance from said means for exclusively interconnecting said lower end portion of each of said cylinders to said bottom edge portion of each of said cylinders.

2. An internal combustion engine according to claim 1 wherein said means for connecting each of said cylinders to said cooling jacket are disposed at a distance from said bottom edge portion of each of said cylinders corresponding to 0.6 to 0.7 times said cylinder diameter.

3. An internal combustion engine according to claim 1 further comprising:

a crankcase integral with said cylinder block; and a plurality of main bearing walls disposed between said lower end portion of each of said cylinders and provided for supporting said main bearings and having an opening provided in each of said main bearing walls.

4. An internal combustion engine according to claim 3 wherein said cylinder block, said cooling jacket, said means for connecting each of said cylinders to said cooling jacket, said means for exclusively interconnecting said lower end portion of each of said cylinders and said crankcase are homogeneously formed in one piece by casting.

* * * * *